US007507005B1

(12) United States Patent
Mier-Langner

(10) Patent No.: US 7,507,005 B1
(45) Date of Patent: Mar. 24, 2009

(54) SLIDING FLEXIBLE TRACK LIGHTING

(75) Inventor: Alejandro Mier-Langner, Providence, RI (US)

(73) Assignee: Genlyte Thomas Group LLC, Louisville, KY (US)

( * ) Notice: Subject to any disclaimer, the term of this patent is extended or adjusted under 35 U.S.C. 154(b) by 247 days.

(21) Appl. No.: 11/668,700

(22) Filed: Jan. 30, 2007

(51) Int. Cl.
*F21S 8/08* (2006.01)

(52) U.S. Cl. ..... 362/418; 362/147; 362/285; 439/111

(58) Field of Classification Search ..... 362/382, 362/147, 418, 285; 439/110–111
See application file for complete search history.

(56) References Cited

U.S. PATENT DOCUMENTS

| | | | |
|---|---|---|---|
| 1,830,355 | A | 11/1931 | Farr |
| 1,885,513 | A | 11/1932 | Mask |
| 2,026,884 | A | 1/1936 | Glasgow |
| 2,220,220 | A | 11/1940 | Cusimano |
| 2,856,592 | A | 10/1958 | Carlson |
| 2,946,037 | A | 7/1960 | Platz et al. |
| 2,967,230 | A | 1/1961 | Goetz et al. |
| 3,120,985 | A | 2/1964 | Hubbell |
| 3,246,135 | A | 4/1966 | Husby |
| 3,273,103 | A | 9/1966 | Ericson |
| 3,303,336 | A | 2/1967 | Husby |
| 3,391,377 | A | 7/1968 | Corl et al. |
| 3,529,275 | A | 9/1970 | Routh |
| 3,559,146 | A | 1/1971 | Valtonen |
| 3,622,938 | A | 11/1971 | Masamichi et al. |
| 3,646,501 | A | 2/1972 | Valtonen |
| 3,686,614 | A | 8/1972 | Hyrylainen |
| 3,718,886 | A | 2/1973 | Hoffmeister |
| 3,757,273 | A | 9/1973 | Hesse |
| 3,760,133 | A | 9/1973 | Howard |
| 3,832,503 | A | 8/1974 | Crane |
| 3,832,673 | A | 8/1974 | Le Hir |
| 3,848,715 | A | 11/1974 | Hesse |
| 3,884,541 | A | 5/1975 | O'Nan et al. |
| 3,894,781 | A | 7/1975 | Donato |
| 3,933,403 | A | 1/1976 | Rubesamen et al. |
| 3,980,368 | A | 9/1976 | Fremont |
| 3,993,385 | A | 11/1976 | Seger |
| 4,029,378 | A | 6/1977 | Bolis |
| 4,032,208 | A | 6/1977 | Berkenhoff |
| 4,053,194 | A | 10/1977 | Gilman |
| 4,085,988 | A | 4/1978 | Gamble |
| 4,108,523 | A | 8/1978 | Bolis |
| 4,139,252 | A | 2/1979 | Gorny |
| 4,139,525 | A | 2/1979 | Gorny |
| 4,181,388 | A | 1/1980 | Donato |
| 4,200,862 | A | 4/1980 | Campbell et al. |
| 4,211,460 | A | 7/1980 | Seelbach et al. |
| 4,218,108 | A | 8/1980 | El Mouchi |
| 4,236,194 | A | 11/1980 | Norman |

(Continued)

*Primary Examiner*—Ali Alavi
(74) *Attorney, Agent, or Firm*—Chad D. Bruggeman; John F. Salazar; Middleton Reutlinger

(57) ABSTRACT

A flexible track for use in a track lighting system which includes two elongated track members mounted back-to-back which can be manually set and secured into a desired curved configuration. The elongated flexible track members are parallel and adjacent to each other with conductors positioned in channels on the lateral faces of the flexible track, capable of engaging one or more light fixtures. Each track member can slide relative to the other creating a mechanism that allows for large or small diameter curves of the flexible track.

24 Claims, 8 Drawing Sheets

U.S. PATENT DOCUMENTS 4,289,365 A 9/1981 Rutgers
4,375,106 A 2/1983 Voll
4,380,792 A 4/1983 Terrell
4,392,187 A 7/1983 Bornhorst
4,508,400 A 4/1985 Herbert
4,533,190 A 8/1985 Booty
4,557,547 A 12/1985 Stuart
4,598,345 A 7/1986 Kleeman
4,655,520 A 4/1987 Cummings
4,676,567 A 6/1987 Mouchi
4,684,822 A 8/1987 Angott
4,699,439 A 10/1987 Cohen
4,712,167 A 12/1987 Gordin et al.
4,722,030 A 1/1988 Bowden
4,727,460 A 2/1988 Payne
4,779,168 A 10/1988 Montgomery
4,790,766 A 12/1988 Booty, Sr. et al.
4,797,795 A 1/1989 Callahan
4,822,292 A 4/1989 Thayer et al.
4,861,273 A * 8/1989 Wenman et al. ..... 439/111
4,887,196 A 12/1989 Brown et al.
4,931,917 A 6/1990 Scherf et al.
4,947,302 A 8/1990 Callahan
4,968,262 A 11/1990 Widell et al.
4,979,081 A * 12/1990 Leach et al. ..... 362/219
5,013,251 A 5/1991 Stringer et al.
5,031,082 A 7/1991 Bierend
5,038,261 A 8/1991 Kloos
5,055,746 A 10/1991 Hu et al.
5,072,216 A 12/1991 Grange
5,151,037 A 9/1992 Range et al.
5,151,038 A 9/1992 Range et al.
5,176,442 A 1/1993 Richardson
5,192,126 A 3/1993 Remeyer et al.
5,209,560 A 5/1993 Taylor et al.
5,329,431 A 7/1994 Taylor et al.
5,336,097 A 8/1994 Williamson, Jr. et al.
5,347,431 A 9/1994 Blackwell et al.
5,382,947 A 1/1995 Thaler et al.
5,406,176 A 4/1995 Sugden
5,502,627 A 3/1996 Hunt et al.
5,506,715 A 4/1996 Zhu
5,517,391 A * 5/1996 Grau ..... 362/147
5,526,245 A 6/1996 Davis et al.
5,554,979 A 9/1996 Kohar et al.
5,593,224 A 1/1997 Kunkel et al.
5,593,244 A 1/1997 Kunkel et al.
5,637,964 A 6/1997 Hakkarainen et al.
5,695,279 A * 12/1997 Sonnleitner et al. ..... 362/419
D389,460 S 1/1998 Wei-Hong
5,731,664 A 3/1998 Posa
5,769,531 A 6/1998 Hunt et al.
5,803,755 A 9/1998 Kuchar et al.
D399,594 S 10/1998 Patik
5,833,358 A 11/1998 Patik
5,855,485 A 1/1999 Patti
5,921,659 A 7/1999 Hunt et al.
5,938,362 A 8/1999 Bastiansen
5,988,838 A 11/1999 Rudenberg
5,989,067 A 11/1999 Morgan et al.
6,004,005 A 12/1999 Demshki, Jr.
6,032,432 A 3/2000 Patti
6,079,992 A 6/2000 Kuchar et al.
6,095,669 A * 8/2000 Cho ..... 362/365
6,120,262 A 9/2000 McDonough et al.
6,127,925 A 10/2000 Bonsignore et al.
6,130,412 A 10/2000 Sizemore
6,163,275 A 12/2000 Hartzell
6,169,377 B1 1/2001 Byrde et al.
6,174,073 B1 1/2001 Regan et al.
6,192,282 B1 2/2001 Smith et al.
6,220,721 B1 4/2001 Chan et al.
6,273,578 B1 8/2001 Demshki
6,273,587 B1 8/2001 Demshki
6,312,140 B1 * 11/2001 McGuire ..... 362/250
6,567,032 B1 5/2003 Mullaly et al.
6,616,465 B1 9/2003 Fontana et al.
RE38,259 E 10/2003 Kuchar et al.
6,655,817 B2 12/2003 Devlin et al.
6,687,487 B1 2/2004 Mosebrook et al.
7,018,072 B2 3/2006 Mier-Langner et al.
7,024,119 B1 4/2006 Mier-Langner et al.
7,027,736 B1 4/2006 Mier-Langner et al.
7,092,257 B2 8/2006 Westerheide
7,111,957 B2 9/2006 Bernhart et al.
7,137,727 B2 11/2006 Joseph et al.
2001/0040805 A1 11/2001 Lansing et al.
2004/0005798 A1 * 1/2004 Lin ..... 439/110
2004/0218395 A1 * 11/2004 Westerheide ..... 362/418

* cited by examiner

SLIDING FLEXIBLE TRACK LIGHTING

BACKGROUND OF THE INVENTION

1. Field of the Invention

This invention relates to a track lighting system for use with one or more light fixtures. A track lighting system connects the light fixtures to the power source and allows the fixtures to be set in various positions according to the needs of the user. More particularly, the present invention relates to such a system where the track is required to be set in a curved position, and employs a sliding mechanism for the flexible track members which allow each track member to slide relative to the other.

2. Description of the Related Art

Various track lighting systems have been proposed in the art. These devices generally include line voltage track lighting. Track lighting systems that operate lamps at 120 volts are termed line voltage track lighting.

The line voltage track lighting is most commonly built with metal extrusions that create a rigid structure limiting the flexibility of the track to conform to certain curved applications. The insulation of the conductors also increases the rigidness of the track and its profile.

SUMMARY OF THE INVENTION

The track lighting system according to exemplary embodiments of the present invention comprises a flexible track which is formed from two elongated track members mounted back-to-back, which can be manually set and secured into a desired curved configuration. The elongated flexible track members are parallel and adjacent to each other with the conductors positioned in channels on the outside faces of the flexible track, which allows it to be surface mounted to a ceiling or other relatively flat surface. The flexible track is capable of engaging one or more light fixtures. The track members are configured so that they can slide relative to each other creating a mechanism that allows for the formation of large or small diameter curves in the flexible track. Since the track members can slide relative to each other when flexed to form a desired curved configuration, the compression and stretching problems of the prior art discussed above can be overcome.

Therefore, a general object is to provide a track lighting system having a construction which allows it to be manually flexed and secured into a desired curved configuration without the use of large tools or machinery.

Another object is to provide a track lighting system, as aforesaid, which has a construction which allows the user to manually change the curved configuration of the track without the cost of either re-working a curved piece whose shape has been essentially fixed, or of buying replacement track to replace the previously curved piece.

Another object is to provide a track lighting system, as aforesaid, which utilizes conductors placed on the lateral surfaces of the flexible track to allow for a smaller profile of the track, and surface mounting of the system.

Yet another object is to provide a track lighting system, as aforesaid, which utilizes the flexibility and slidability of the track members to allow the outer track member to flex at a larger radius than the inner track member, allowing the manual formation of smaller radius curve configurations.

Another object is to provide a track lighting system, as aforesaid, which utilizes the flexibility and slidability of the track members to minimize compression and stretching of the track upon curving, which can minimize breaking or fatigue.

Other objects and advantages will become apparent from the following description taken in connection with the accompanying drawings, wherein is set forth by way of illustration and examples, embodiments of this invention.

DETAILED DESCRIPTION

Figure 6:
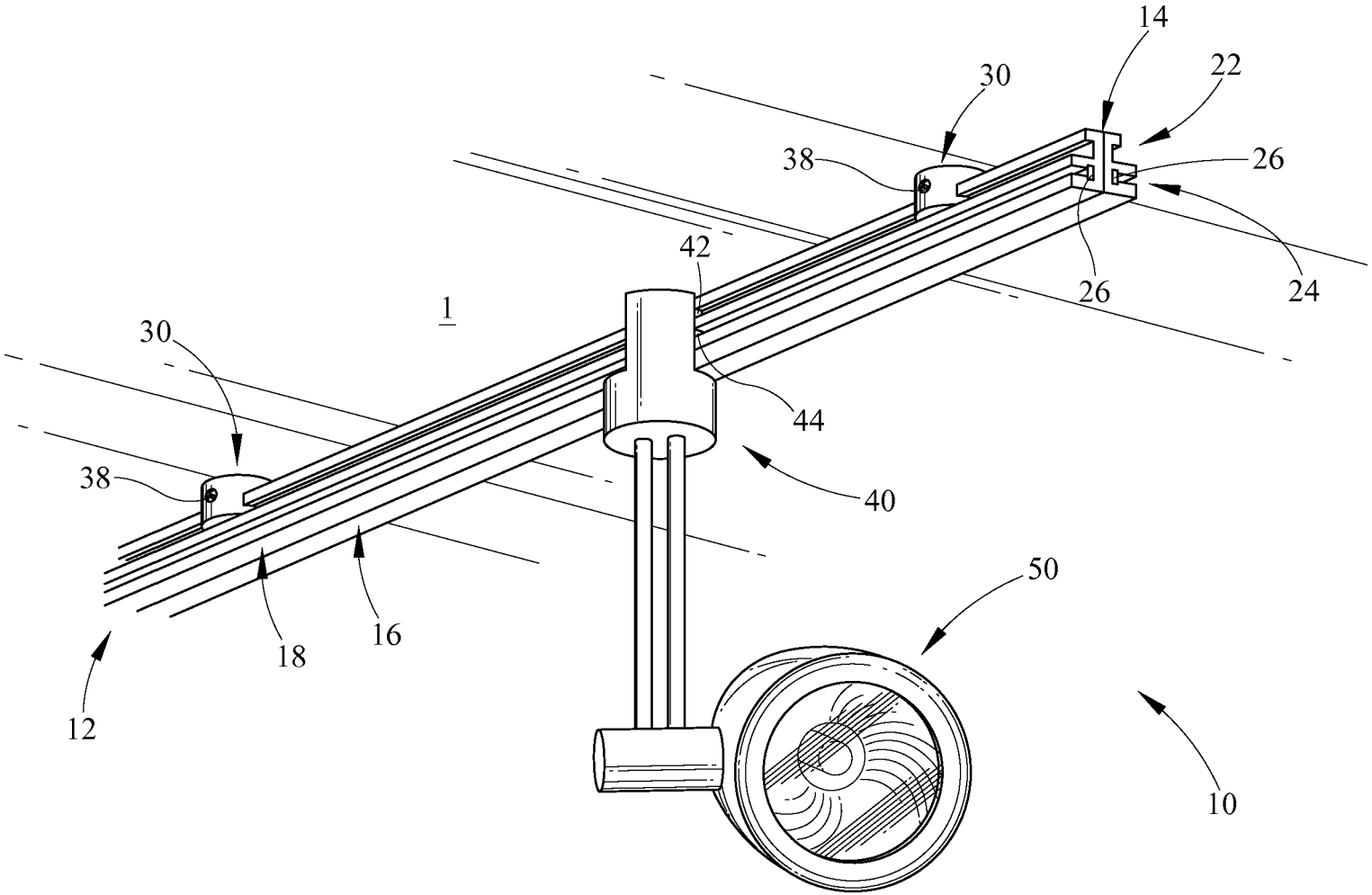
FIG. 6 is a bottom perspective view illustrating a surface mounting of a straight, unflexed configuration of the sliding flexible track with a light fixture attached thereto.
Figure 7:
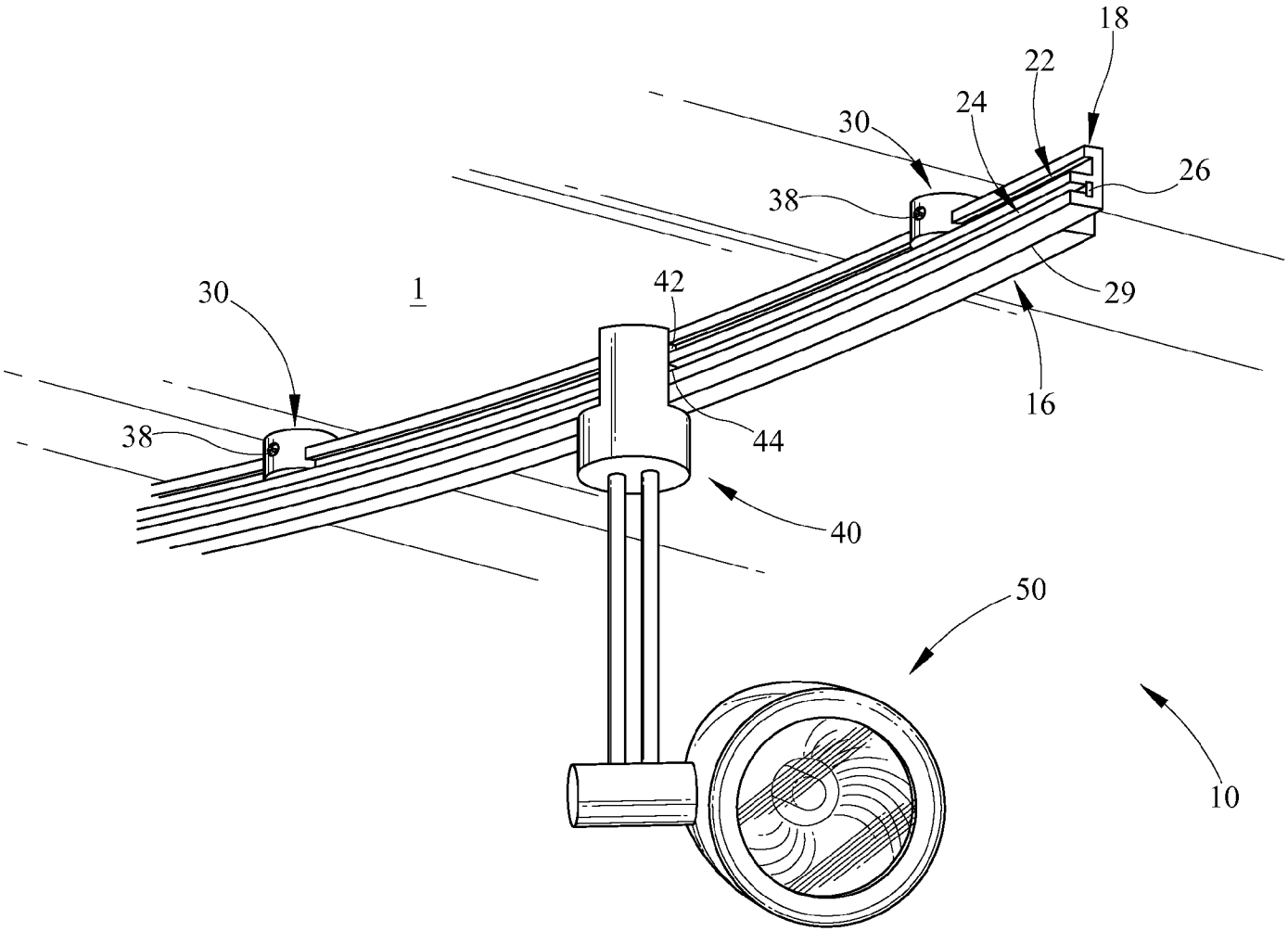
FIG. 7 is a bottom perspective view illustrating a curved configuration of the sliding flexible track lighting system mounted on a surface.

The sliding flexible track lighting system 10 depicted in FIGS. 6 and 7 of the drawings allows for the sliding of two flexible track members 20 which can be manually set and secured in a curved position in order to arrange one or more light fixtures 50. Each flexible track member 20 can slide relative to the other creating a mechanism that allows for large or small diameter curves to be formed. The sliding flexible track lighting system can be used in line voltage applications as well as low voltage applications.

Figure 1:
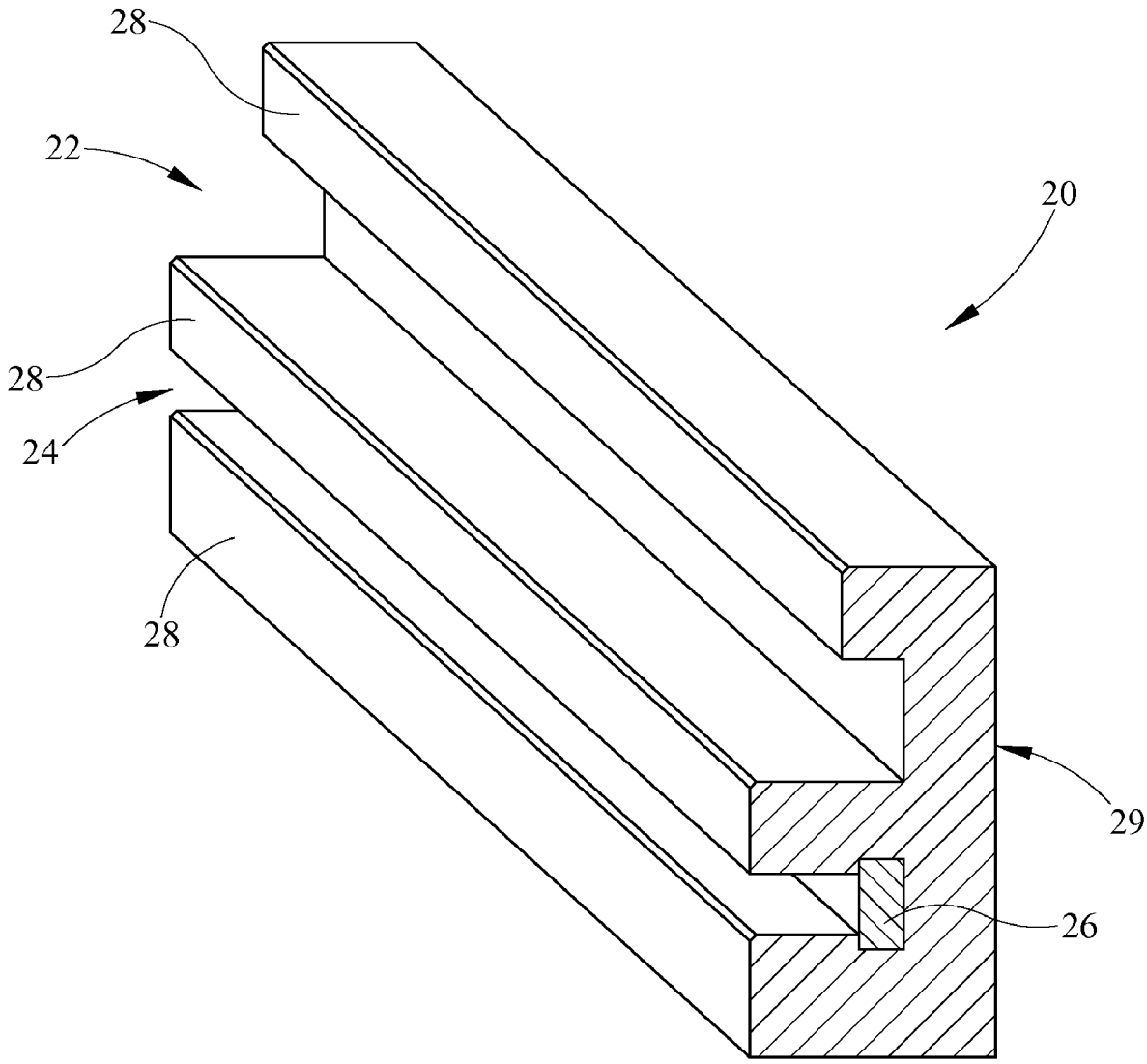
FIG. 1 is a top perspective view of a section of a single flexible track member according to one embodiment of the present invention.

As shown in FIG. 1 a flexible track member 20 is an elongated member containing channels on an outside surface 28. A top channel 22 provides a retaining ledge or rail for attachment to either a track mounting bushing 30 (FIGS. 2A, 2B) or mounting adaptor 40 (FIGS. 3A, 3B). A bottom channel 24 contains a strip conductor 26 running the length of the channel for the conduction of electrical current. Flexible track member 20 is formed from a plastic material which is preferably, but not limited to, an extrudable polycarbonate which is capable of maintaining a sufficient thermal rating. Flexible track member 20 is preferably co-extruded with the strip conductor 26. However, strip conductor 26 can be incorporated into flexible track member 20 by various other means and in other positions while still maintaining the sliding mechanism between the two flexible track members 20 as depicted herein as well as incorporating other embodiments of the present invention.

Figure 2A:
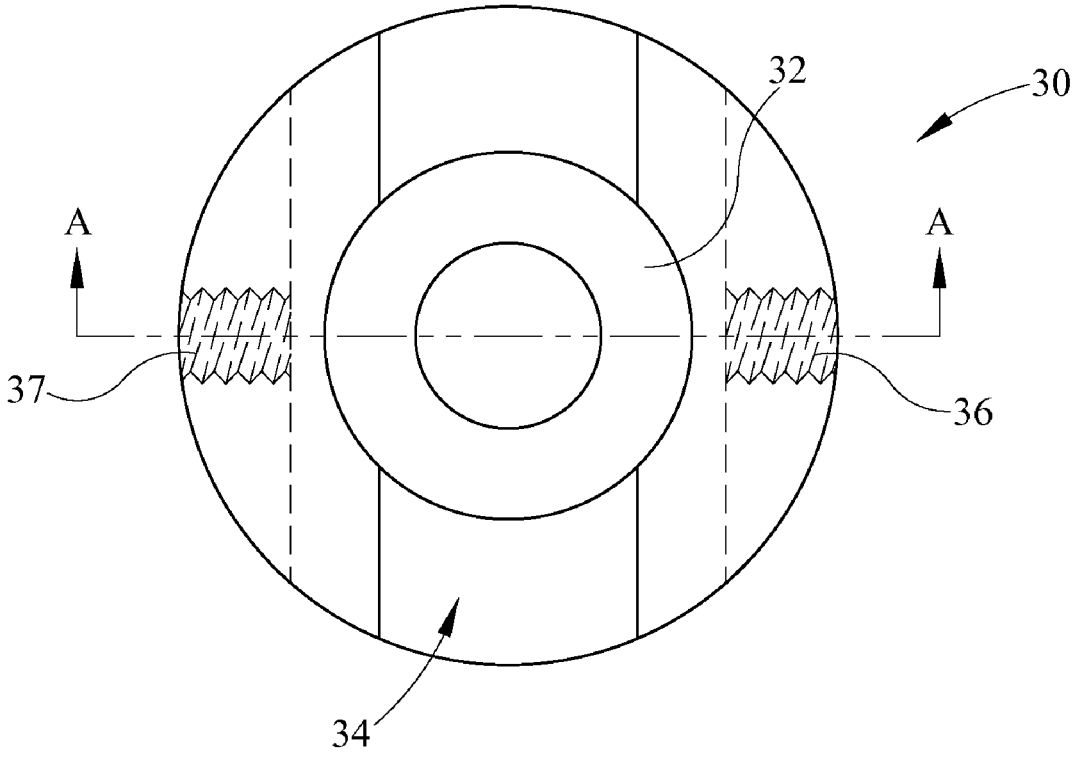
FIG. 2A is a bottom view of a track mounting bushing.
Figure 2B:
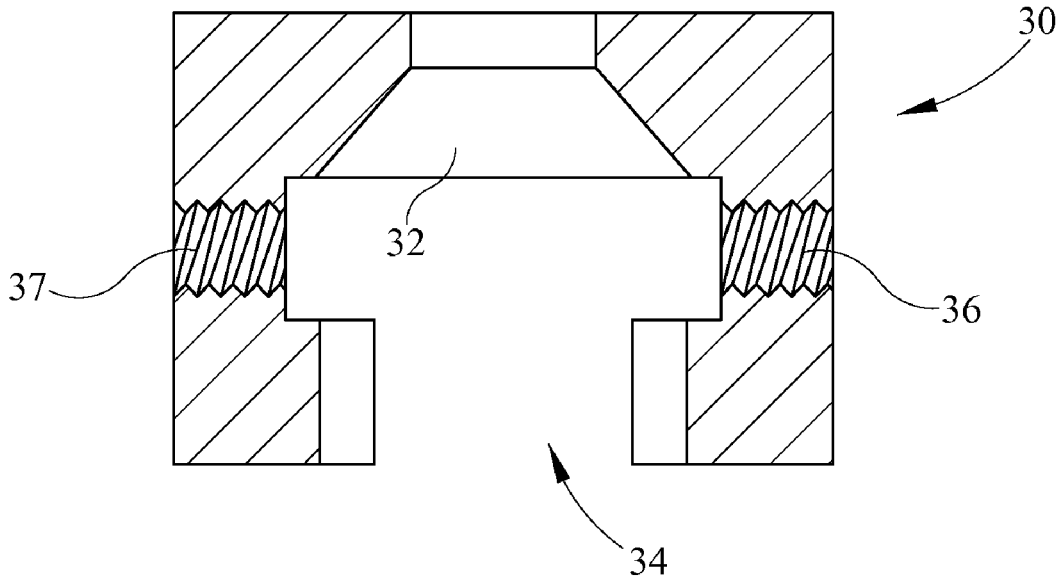
FIG. 2B is a sectional view taken along line A-A of FIG. 2A.
Figure 3A:
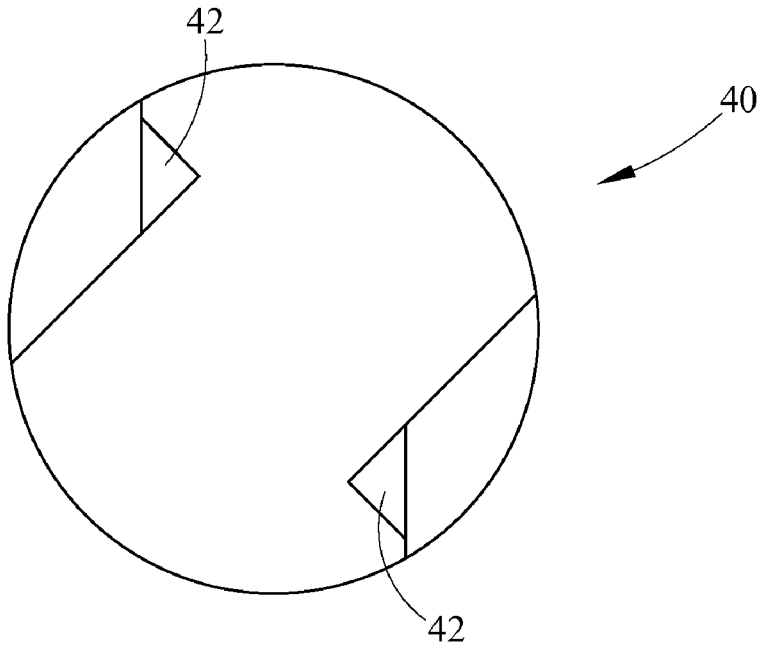
FIG. 3A is a top view of a mounting adaptor for a light fixture which is placed on the sliding flexible track.
Figure 3B:
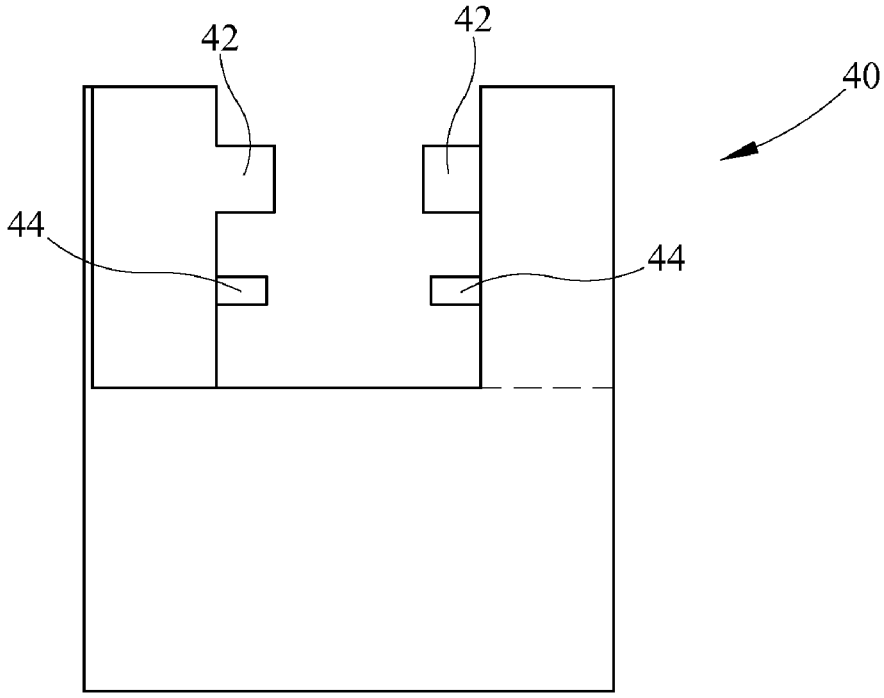
FIG. 3B is a side view of the mounting adaptor of FIG. 3A.
Figure 4:
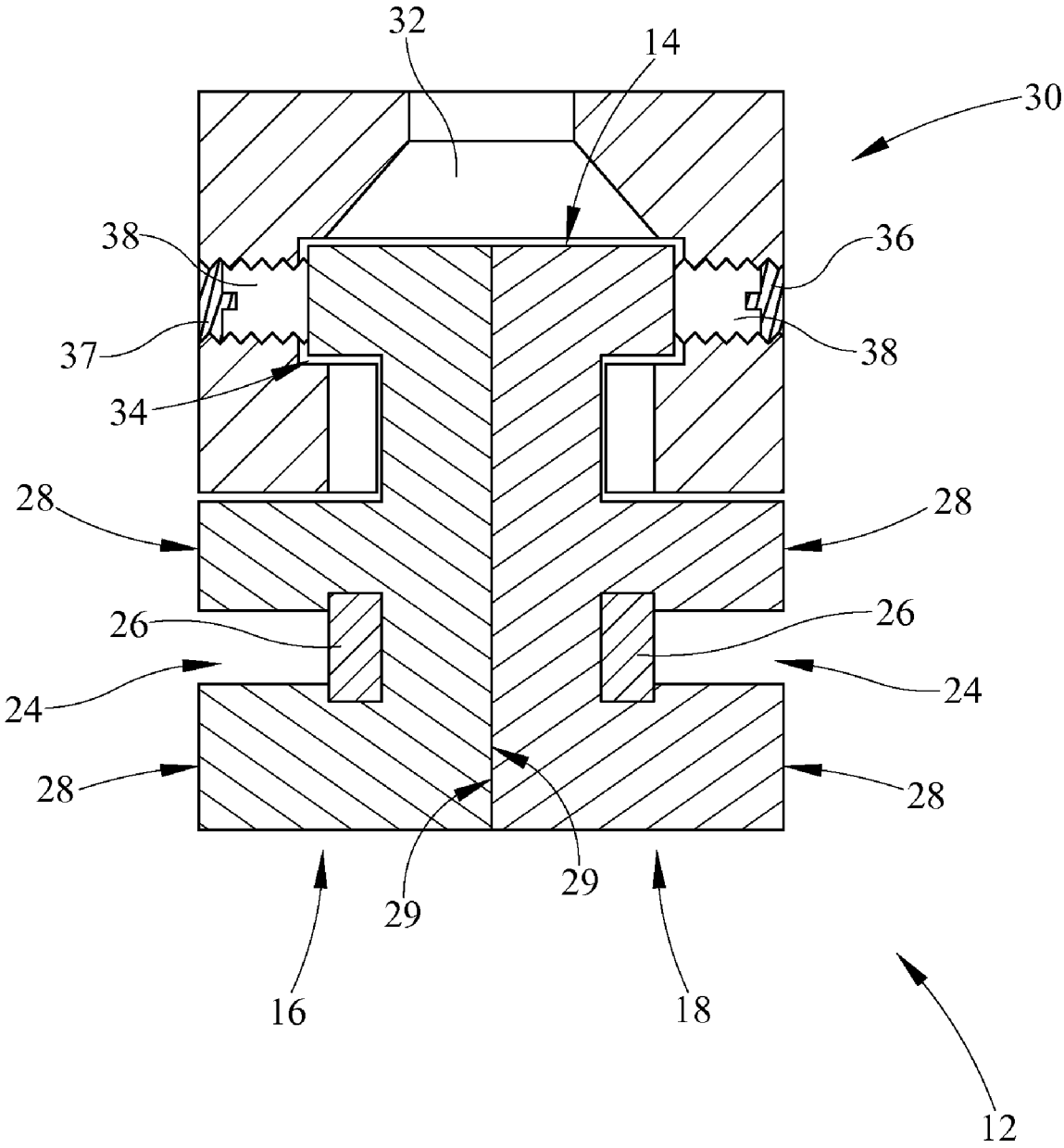
FIG. 4 is a sectional view of the track mounting bushing supporting the two-member flexible track of one embodiment of the present invention.
Figure 5A:
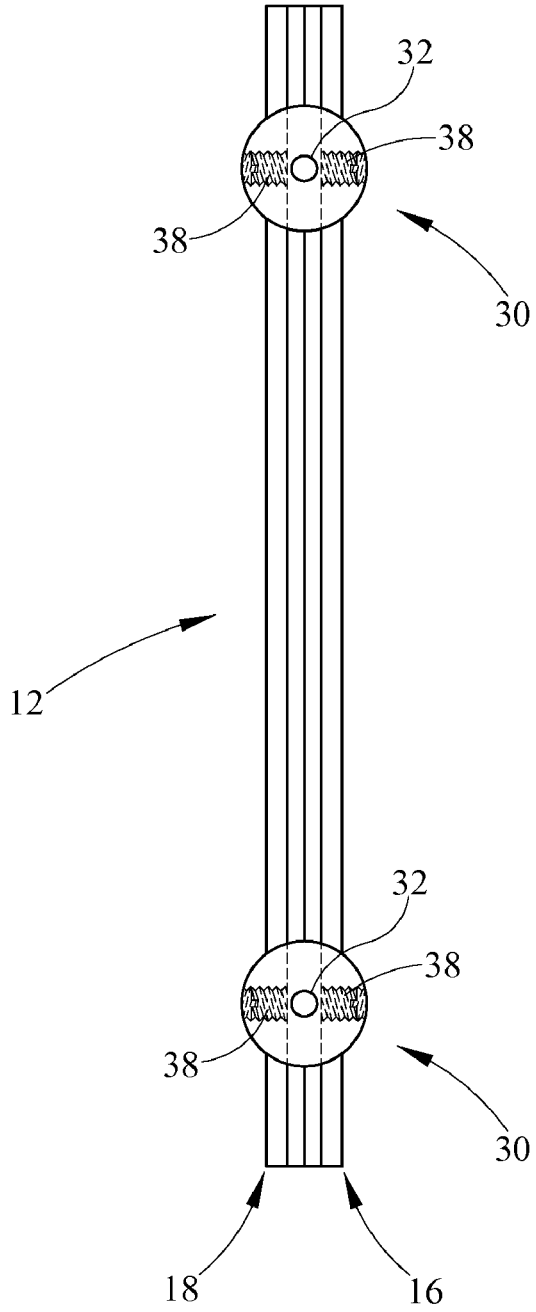
FIG. 5A is a top plan view illustrating an unflexed configuration of the two flexible track members of the flexible track of another embodiment of the invention.
Figure 5B:
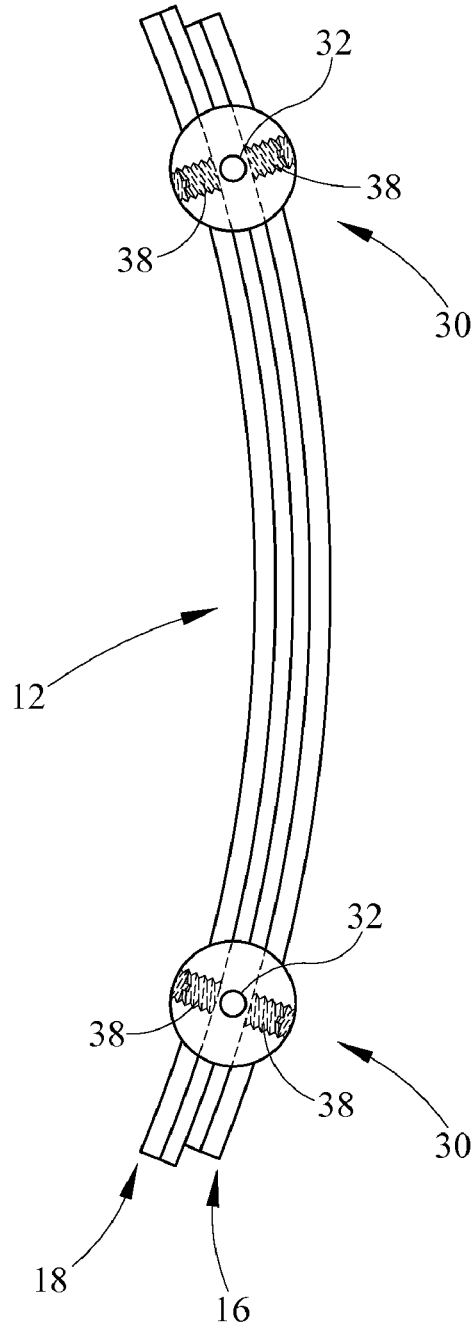
FIG. 5B is a top plan view illustrating a flexed configuration of the two flexible track members positioned after curvature of the sliding flexible track is set and secured by the track mounting bushings.

As shown in FIGS. 2A, 2B and 4, a track mounting bushing 30 provides for securing the two track members 16, 18 together in side by side relationship against a mounting surface. Track mounting bushing 30 has a countersunk thru hole 32 through which a mounting screw (not illustrated) is inserted to fix the bushing onto a surface. Track mounting bushing 30 also has two threaded thru holes 36, 37 on the sides through which set screws 38 are inserted to clamp the two flexible track members 16, 18 together to maintain the desired curve. A plurality of mounting bushings 30 are used to manually create and set or secure the desired curved configuration for the sliding flexible track (FIGS. 5B, 7). Mounting bushing 30 has a T-slot 34 passing horizontally therethough which secures the sliding flexible track 12 as shown in FIG. 4, to manually set the configuration of the sliding flexible track 12. The two track members 16, 18 slide relative to each other along inside surfaces 29 while positioned in the T-slot 34 to allow track 12 to flex into a curved position (FIGS. 5B, 7). As shown in FIGS. 4, 5B, and 7, mounting bushing 30 has two set screws 38 on opposing sides which clamp the two pieces of track 16, 18 together maintaining the desired curve. Any curve at any bushing 30 is maintained by set screws 38. Without set screws 38 or other securing device known in the art in mounting bushing 30, flexible track 12 would not maintain the curved configuration.

As shown in FIG. 4 the sliding flexible track 12 consists of two flexible track members 16, 18 arranged parallel and adjacent to each other. The two flexible track members 16, 18 contact each other at their inner surfaces 29 where sliding can occur. One embodiment of the two flexible track members 16, 18 have the same profile and when assembled are mirror images of each other. Outer surface 28 of each flexible track member has a strip conductor 26 embedded in bottom channel 24. Mounted back-to-back, the combination of two flexible track members 16, 18 creates a T-shaped rail 14 on the top of the sliding flexible track 12 which is secured by the set screws 38 in the mounting bushing 30 in T-slot 34.

The two flexible track members 16, 18 produce a mechanism which allows the members to slide relative to each other once it is determined that a curved configuration is desired. Referring to FIGS. 5A and 6, the two flexible track members 16, 18 are shown fixed in a straight, unflexed configuration. In FIGS. 5B and 7, the two flexible track members 16, 18 are shown in a curved, flexed configuration created when each member slides relative to the other along the inside surfaces 29. By being capable of sliding relative to each other (FIGS. 5B, 7), outer track member 16 is allowed to flex at a larger radius than inner track member 18. Unlike the prior art, this mechanism for sliding prevents excessive compression of the material on the inner or concave side and excessive stretching of the material on the outer or convex side of the curve. Excessive compression and stretching can lead to breaking or fatigue. Thus, sliding flexible track 12 can be manually flexed and secured, by set screws 38, in a curved configuration (FIGS. 5B, 7) which can be manually modified by changing the positions of mounting bushings 30.

The sliding flexible track 12 not only can be flexed into a curved configuration (FIGS. 5B, 7), but it can be left in its unflexed configuration (FIGS. 5A, 6) to accommodate straight configured installations, or one can combine curved and straight configurations in the same installations. The sliding flexible track lighting system 10 does not require large tools or machinery for pre-installation bending. Flexible track 12 is ready to be installed or replaced without the need of further preparation of the material. As shown in FIGS. 5B and 7, a plurality of mounting bushings 30 are mounted along a surface 1 in the desired configuration of the sliding flexible track 12. Sliding flexible track 12 is then inserted into the bushings 30 and subsequently set and secured by set screws 38 into the desired curved position, while the sliding mechanism substantially reduces the compression and stretching of the track material. This embodiment allows for the design and configuration of the track lighting system 10 to be preplanned before installation, and the convenience of "on the spot" adjustments as needed.

As shown in FIGS. 6 and 7 the sliding flexible track lighting system 10 is mounted to surface 1 with the strip conductors 26 located side to side in each respective channel 24. Side to side strip conductors allow the flexible track 12 to be surface mounted directly to ceilings and other relatively flat surfaces or suspended therefrom. Mounting bushings 30 are attached to surface 1 and spaced along the length of the sliding flexible track 12. This gives flexible track lighting system 10 a low profile from surface 1. Mounting bushings 30 can be configured in a number of different sizes or shapes and still function to set and secure the curvature of the sliding flexible track 12. Also shown in FIGS. 6 and 7, the light fixtures 50 of the system connect to the sliding flexible track 12 by means of a mounting adaptor 40 (FIGS. 3A, 3B). Once the mounting adaptor 40 is placed at its desired location on the sliding flexible track 12, the adapter is then twisted to retain it in the channels 24 located on the outside surface 28 of the flexible track members 16, 18. As shown in FIGS. 3A and 3B, mounting adaptor 40 contains two upper 42 and two lower blades 44. The two lower blades 44 of the adaptor come into contact with the strip conductors 26, located in bottom channel 24, upon twisting of the adaptor. The two lower blades 44 transfer power from each strip conductor 26 to light fixture 50. The upper two blades 42 seat into top channels 22 of the flexible track members 16, 18 (FIG. 1), upon twisting of the adapter 40, and thus retain and secure the light fixture 50 to the track.

Although the sliding flexible track lighting system 10 is shown in the drawings as being surface mounted (FIGS. 6 and 7), track 12 does not have to be directly mounted to a ceiling or other relatively flat surface. Sliding flexible track 12 can be used with various mounting arrangements known in the art. For example, the sliding flexible track 12 could be suspended from the surface with the use of an I-beam suspension structure (not illustrated). Also, the light fixture 50 and mounting adaptor 40 shown are merely representative of luminairies in general, and it should be understood that there are many variations of fixtures and mounting adaptors that may be used with the sliding flexible track 12.

Figure 8:
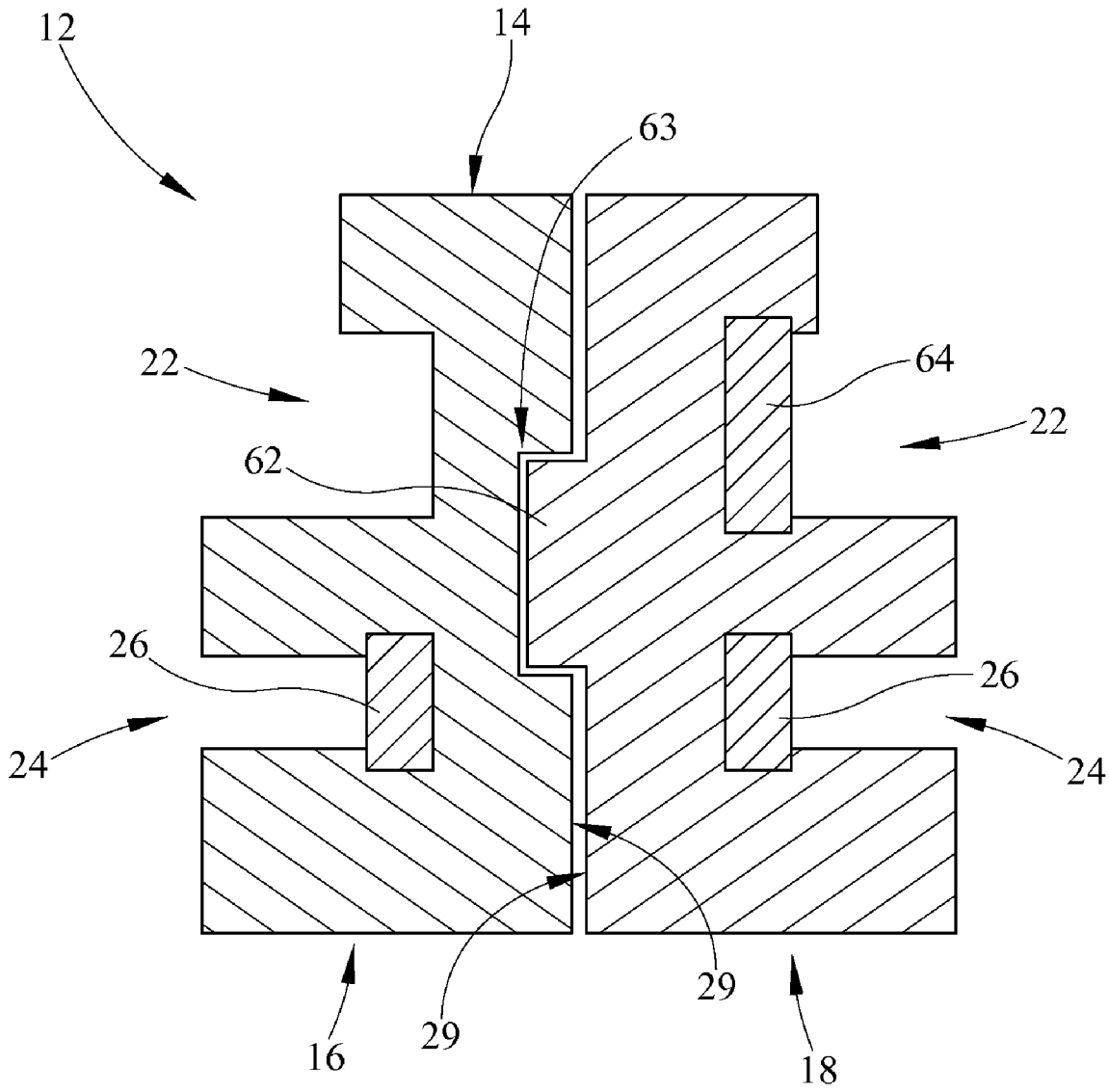
FIG. 8 is a sectional view of another embodiment of the two flexible track members of the sliding flexible track illustrating the positioning of a ground connector and a key connection.

Another embodiment of the present invention as shown in FIG. 8, provides a key connection 62 and a slot 63 between the two flexible track members 16, 18. Key connection 62 is another embodiment of the mechanism which allows the track members 16, 18 to slide relative to each other. Key connection 62 extends longitudinally from inner surface 29 of flexible track 18 and mates within slot 63 which extends longitudinally from inner surface 29 of flexible track 16. Key connection 62 and corresponding slot 63 assists in maintaining the interconnection between each separate track member 16, 18 during the handling and flexing of flexible track 12 into its curved configuration. The profile of the flexible track members 16, 18 as shown with key connection 62 and slot 63 in FIG. 8 is merely representative of another embodiment of the present invention and it should be understood that there are many variations of the profile, including key connection 62 and slot 63, that may be used with the sliding flexible track 12. Thus, the profiles of the two track members 16, 18 do not have to mirror each other to still allow for the desired sliding mechanism.

Also shown in FIG. 8, a ground connector 64 may be incorporated in top channel 22 of a flexible track member 18, or alternatively in track member 16. Ground connector 64 is used in conjunction with the strip conductors 26 to provide for a grounded electrical system for use in the line voltage applications of this embodiment of the present invention.

Not illustrated in the drawings, an inline connector attachment. This inline connector attachment can be used to attach the ends of successive flexible track members 16, 18 both mechanically and electrically to lengthen the sliding flexible track 12 to the desired length of the application.

It is understood that while certain embodiments of the invention have been illustrated and described, it is not limited thereto except insofar as such limitations are included in the following claims and allowable functional equivalents thereof.

I claim:

1. A flexible track for use in a track lighting system comprising:

a first elongated track member having at least one channel extending longitudinally for the length of said first track member along a front surface of said first track member;

a second elongated track member having at least one channel extending longitudinally for the length of said second track member along a front surface of said second track member; and said first and said second elongated track members being in back to back sliding relation with each other.

2. The flexible track as in claim 1 wherein said first and said second track member has a top surface and wherein said top surfaces of each said first and said second track member combine to form a T-shaped rail to mount to a structural surface, when said first and said second track members are in back to back sliding relation.

3. The flexible track as in claim 1 further comprising a first elongated strip conductor extending longitudinally for the length of said at least one channel of said first track member, a second elongated strip conductor extending longitudinally for the length of said at least one channel of said second track member.

4. The flexible track as in claim 1 wherein each said first and said second track member has a second channel extending longitudinally along the length of each said front surface of said first and said second track member, said second channels of said first and said second track member combine to form a rail to mount a track lighting fixture, when said first and said second track members are in back to back sliding relation.

5. The flexible track as in claim 1 wherein each said first and said second track member has a back surface, said second track member having a key connection along said back surface of said second track member, said key connection of said second track member is mated with a slot along said back surface of said first track member.

6. The flexible track as in claim 1 wherein said first track member has a second channel extending longitudinally along the length of said front surface of said first track member, a ground conductor extending longitudinally for the length of said second channel of said first track member.

7. A flexible track for use in a track lighting system comprising:

a first elongated track member having at least one channel extending longitudinally for the length of said first track member along a front surface of said first track member;

a second elongated track member having at least one channel extending longitudinally for the length of said second track member along a front surface of said second track member;

said first and said second elongated track members being in back to back sliding relation with each other;

a first conductor extending longitudinally for the length of said at least one channel of said first track member; and a second conductor extending longitudinally for the length of said at least one channel of said second track member.

8. The flexible track as in claim 7 wherein said first and said second track member has a top surface and wherein said top surfaces of each said first and said second track member combine to form a T-shaped rail to mount to a structural surface, when said first and said second track members are in back to back sliding relation.

9. The flexible track as in claim 7 wherein each said first and said second track member has a back surface, said second track member having a key connection along said back surface of said second track member, said key connection of said second track member is mated with a slot along said back surface of said first track member.

10. The flexible track as in claim 7 wherein said first track member has a second channel extending longitudinally along the length of said front surface of said first track member, a ground conductor extending longitudinally for the length of said second channel of said first track member.

11. A flexible track for use in a track lighting system comprising:

a first and second elongated track member parallel and adjacent to each other;

each said first and said second track member having at least one longitudinal channel extending the length of each said first and said second track member and located on outward facing surfaces of each of said first and said second track member;

said first and said second track members being adapted to be slidably connected along an inward facing surface of each said first and said second track member;

a first elongated strip conductor extending longitudinally for the length of said at least one channel of said first track member; and a second elongated strip conductor extending longitudinally for the length of said at least one channel of said second track member.

12. The flexible track as in claim 11 wherein said first and said second track member has a top surface and wherein said top surfaces of each said first and said second track member combine to form a T-shaped rail to mount to a structural surface, when said first and said second track members are slidably connected.

13. The flexible track as in claim 11 wherein each said first and said second track member has a second channel extending longitudinally along the length of each said outward facing surface of said first and said second track member, said second channels of said first and said second track member combine to form a rail to mount a track lighting fixture, when said first and said second track members are slidably connected.

14. The flexible track as in claim 11 wherein said second track member having a key connection along said inward facing surface of said second track member, said key connection of said second track member is mated with a slot along said inward facing surface of said first track member.

15. The flexible track as in claim 11 wherein said first track member has a second channel extending longitudinally along the length of said outward facing surface of said first track member, a ground conductor extending longitudinally for the length of said second channel of said first track member.

16. A flexible track lighting system comprising:

a first elongated track member having at least one channel extending longitudinally for the length of said first track member along a front surface of said first track member;

a first conductor extending longitudinally for the length of said at least one channel of said first track member;

said first track member having a back surface;

a second elongated track member having at least one channel extending longitudinally for the length of said second track member along a front surface of said second track member;

a second conductor extending longitudinally for the length of said at least one channel of said second track member;

said second track member having a back surface;

said first and said second elongated track members being adapted to be slidably connected along said back surfaces of each said track member;

at least one mounting bushing adapted to secure said first and said second elongated track members to a surface;

at least one mounting adaptor adapted to be releasably connected to said first and said second elongated track members at said first and said second conductor; and at least one light fixture extending from said at least one mounting adaptor.

17. The flexible track lighting system as in claim 16 wherein said first and said second track member has a top surface and wherein said top surfaces of each said first and said second track member combine to form a T-shaped rail to secure to said at least one mounting bushing, when said first and said second track members are slidably connected.

18. The flexible track lighting system as in claim 16 wherein each said first and said second elongated track member has a second channel extending longitudinally along the length of each said front surface of said first and said second track member, said second channels of said first and said second track member combine to form a rail to mount said at least one mounting adaptor, when said first and said second track members are slidably connected.

19. The flexible track lighting system as in claim 16 wherein said second track member having a key connection along said back surface of said second track member, said key connection of said second track member is mated with a slot along said back surface of said first track member.

20. The flexible track lighting system as in claim 16 wherein said first track member has a second channel extending longitudinally along the length of said front surface of said first track member, a ground conductor extending longitudinally for the length of said second channel of said first track member.

21. A flexible track for use in a track lighting system comprising:

a first elongated track member having at least one channel extending longitudinally for the length of said first track member along a front surface of said first track member;

a second elongated track member having at least one channel extending longitudinally for the length of said second track member along a front surface of said second track member;

said first elongated track member being adapted to be slidably connected to said second elongated track member along a back surface of each said first and said second elongated track member;

a first elongated strip conductor extending longitudinally for the length of said at least one channel of said first track member; and a second elongated strip conductor extending longitudinally for the length of said at least one channel of said second track member.

22. The flexible track as in claim 21 wherein said first and said second track member has a top surface and wherein said top surfaces of each said first and said second track member combine to form a T-shaped rail to mount to a structural surface, when said first and said second track members are slidably connected.

23. The flexible track as in claim 21 wherein said second track member having a key connection along said back surface of said second track member, said key connection of said second track member is mated with a slot along said back surface of said first track member.

24. The flexible track as in claim 21 wherein said first track member has a second channel extending longitudinally along the length of said front surface of said first track member, a ground conductor extending longitudinally for the length of said second channel of said first track member.

* * * * *